US011795651B2

(12) United States Patent
Kwarcinski

(10) Patent No.: US 11,795,651 B2
(45) Date of Patent: Oct. 24, 2023

(54) METHOD FOR STRUTTING BRACE LEGS IN AN EARTH-RETAINING STRUCTURE OF AN EXCAVATION SUPPORT SYSTEM, AND SYSTEM OF ELEMENTS USED FOR PURPOSES OF THIS METHOD

(71) Applicant: ISPS SP. Z. O O., Katowice (PL)

(72) Inventor: Pawal Kwarcinski, Katowice (PL)

(73) Assignee: ISPS SP. Z O.O., Katowice (PL)

( * ) Notice: Subject to any disclaimer, the term of this patent is extended or adjusted under 35 U.S.C. 154(b) by 148 days.

(21) Appl. No.: 17/428,698

(22) PCT Filed: Feb. 13, 2020

(86) PCT No.: PCT/PL2020/000014
§ 371 (c)(1),
(2) Date: Aug. 5, 2021

(87) PCT Pub. No.: WO2020/167148
PCT Pub. Date: Aug. 20, 2020

(65) Prior Publication Data

US 2022/0120051 A1 Apr. 21, 2022

(30) Foreign Application Priority Data

Feb. 17, 2019 (PL) ..... 428941

(51) Int. Cl.
*E02D 17/08* (2006.01)
*E02D 17/04* (2006.01)

(52) U.S. Cl.
CPC ..... *E02D 17/083* (2013.01); *E02D 17/04* (2013.01)

(58) Field of Classification Search
CPC ..... E02D 17/083; E02D 17/04; E02D 17/08
See application file for complete search history.

(56) References Cited

U.S. PATENT DOCUMENTS 4,472,090 A * 9/1984 Krings ..... E02D 17/083 248/228.6
4,787,781 A * 11/1988 Bradberry ..... E02D 17/083 405/282

(Continued)

FOREIGN PATENT DOCUMENTS

CN 206902928 U 1/2018
CN 208288865 U 12/2018

(Continued)

OTHER PUBLICATIONS

"Other common transmission mechanisms," Basics of Automobile Machinery, Zou Yuqing et al., pp. 258-259 (Chapter 9), Beijing Institute of Technology Press, Aug. 2015 [Date accessed: Sep. 15, 2022].

*Primary Examiner* — Carib A Oquendo
(74) *Attorney, Agent, or Firm* — Michael J. Feigin, Esq.; Feigin and Fridman LLC

(57) ABSTRACT

The method is used for strutting brace legs in a quadrangular setup of a rim of brace legs. The method consists in that a spreader (3) is attached to one end of each brace leg (2), while an extendable tensioning unit (4) is attached to the other end of the same brace leg (2). Next, the brace legs (2) are set inside the excavation in such a manner that, in the excavation corners, the ends of the brace legs (2) terminated with spreaders (3) become coupled with the ends of the subsequent brace legs (2) terminated with tensioning units. Once all the brace legs (2) have been coupled with each other, the ends of the brace legs (2), with the spreaders (3) attached to them, are pressed against the sheet piles (1) in the excavation corners by means of tensioning units (4) attached to subsequent brace legs (2).

2 Claims, 4 Drawing Sheets

(56) References Cited

U.S. PATENT DOCUMENTS

| | | | | |
|---|---|---|---|---|
| 5,503,504 | A * | 4/1996 | Hess | E02D 17/08 405/282 |
| 7,837,413 | B1 * | 11/2010 | Kundel, Sr. | E02D 17/08 248/644 |
| 9,441,341 | B1 * | 9/2016 | Hames | E02D 17/083 |
| 2004/0223814 | A1 | 11/2004 | Meyer | |
| 2006/0002768 | A1 | 1/2006 | Meyer et al. | |
| 2009/0047074 | A1 * | 2/2009 | Meyer | E02D 17/08 405/283 |
| 2009/0110490 | A1 * | 4/2009 | Hess | E02D 17/08 405/282 |
| 2017/0002538 | A1 * | 1/2017 | Parker | E02D 17/083 |

FOREIGN PATENT DOCUMENTS

| | | | |
|---|---|---|---|
| GB | 2166774 | A | 5/1986 |
| JP | S5873623 | A | 5/1983 |
| JP | 200064287 | A | 2/2000 |

* cited by examiner

METHOD FOR STRUTTING BRACE LEGS IN AN EARTH-RETAINING STRUCTURE OF AN EXCAVATION SUPPORT SYSTEM, AND SYSTEM OF ELEMENTS USED FOR PURPOSES OF THIS METHOD

FIELD OF THE INVENTION

The subject of the invention is a method for strutting brace legs in an earth-retaining structure of an excavation support system, and a system of elements used for purposes of this method.

BACKGROUND

There is a known method for strutting brace legs in an earth-retaining structure of an excavation support system using corner struts as well as struts that are perpendicular to excavation walls, where the force holding the brace leg against the earth-retaining structure's sheet pile is generated by means of a hydraulic telescopic spreader with a travel of ca. 60-70 cm as well as intercoupled rigid strutting beams, also coupled with the spreader, with a length of 0.5 m, 1 m, 2 m, etc. Depending on the excavation shoring variant, these elements are mounted between the brace legs which support the excavation's retaining walls, and they are fixed to the latter by means of removable strut lugs seated on I-section type brace legs. Each time the strut is set out at a specific location, these lugs are secured against uncontrolled travel along the brace leg with travel locking elements welded to them. Using the struts according to the known method to secure a specific excavation consists of initially determining their respective lengths, which correspond to the distances between individual points at which struts and brace legs are coupled. This is performed by adjusting the protrusion of a slid out piston tied to the hydraulic spreader's strut, after all struts have been coupled with strut lugs and working pressure is delivered at the same time to all hydraulic spreaders, the effect of which is uniform thrust of sheet piles against the soil forming the excavation walls. The thrust of the struts against the brace legs is relieved by simultaneously reducing the working pressure in all hydraulic spreaders. A model solution making use of the method in question has been presented in a description of a shoring device according to U.S. Pat. No. 4,787,781.

A flaw of the known method is the necessity to weld new travel locking elements in new brace leg locations, different than before, in the event that the same brace legs are to be used multiple times. This makes it necessary to perform some additional activities when removing old elements, including cleaning the brace leg surface of paint, welding new locking elements and painting them. Another shortcoming of the known method is the necessity to leave the hydraulic spreader in the strut structure for the entire excavation shoring time, which not only increases costs, since many struts are typically used in the same excavation, but also entails a risk of oil leakage from spreader cylinders which may consequently weaken the entire excavation shoring structure with the passing of time.

BRIEF SUMMARY OF THE INVENTION

The method for strutting brace legs according to the invention applies to an earth-retaining structure of an excavation support system in a quadrangular setup of the rim of brace legs. As per the method in question, a spreader, preferably telescopic, is attached to one end of each brace leg, providing the brace leg extension, while an extendable tensioning unit with a spread locking feature is attached to the other end of the same brace leg, providing the brace leg extension. Next, once the distance between the opposite excavation sheet piles has been measured and the length of the brace legs thus prepared has been pre-set according to the measurement results, the brace legs are set inside the excavation at a pre-assumed depth in such a manner that, in the excavation corners, the ends of the brace legs terminated with spreaders become coupled with the ends of the subsequent brace legs terminated with tensioning units. Once all the brace legs have been coupled with each other, preferably using pins, they are pressed against the sheet piles in the excavation corners, and the position of brace leg ends, with the spreaders attached to them, is fixed by means of tensioning units attached to subsequent brace legs.

The system of elements intended for the strutting of brace legs according to the invention constitutes the fittings of one of four corners of the quadrangular rim of the brace legs supporting the excavation sheet piles. The crux of the solution is that a preferably telescopic spreader, terminated with a spreader mounting lug, is attached to one end of each of the four brace legs, thus forming the brace leg extension. A tensioning unit is attached to the other end of the same brace leg, also providing the brace leg extension, The tensioning unit comprises an I-section to which an axially arranged lug is mounted at one end and a retaining block, featuring a centrally positioned straight-through block hole, is rigidly mounted on the opposite end. Past the retaining element, a sliding panel is seated on the I-section. The panel is composed of a base plate, protruding beyond the I-section's outline, and two limiting plates attached to the base plate's sides by means of spacing plates. The limiting plates are fixed to the base plate by means of two rows of mounting bolts, while beyond the base plate, the spacing plates and the limiting plates have been tightly fixed together and loosely embrace the I-section flanges. Welded to the base plate, there is a transverse retaining element with a centrally positioned straight-through tensioning hole and two parallel lateral lugs. The block hole and the tensioning hole are penetrated by a tensioning stud with working nuts on both its ends. In each of the four corners of the rim of brace legs, attached to the brace leg of the first pair of brace legs, the spreader is coupled with the tensioning unit attached to the brace leg of the second pair of brace legs. The element providing the coupling between the spreader and the tensioning unit in the corner of the rim of brace legs is a pin that is inserted into the overlapping holes of the spreader mounting lug and the pair of lateral lugs.

BRIEF DESCRIPTION OF THE DRAWINGS

An example of the invention has been depicted in a series of figures, where.

DETAILED DESCRIPTION OF EMBODIMENTS OF THE INVENTION

Figure 1:
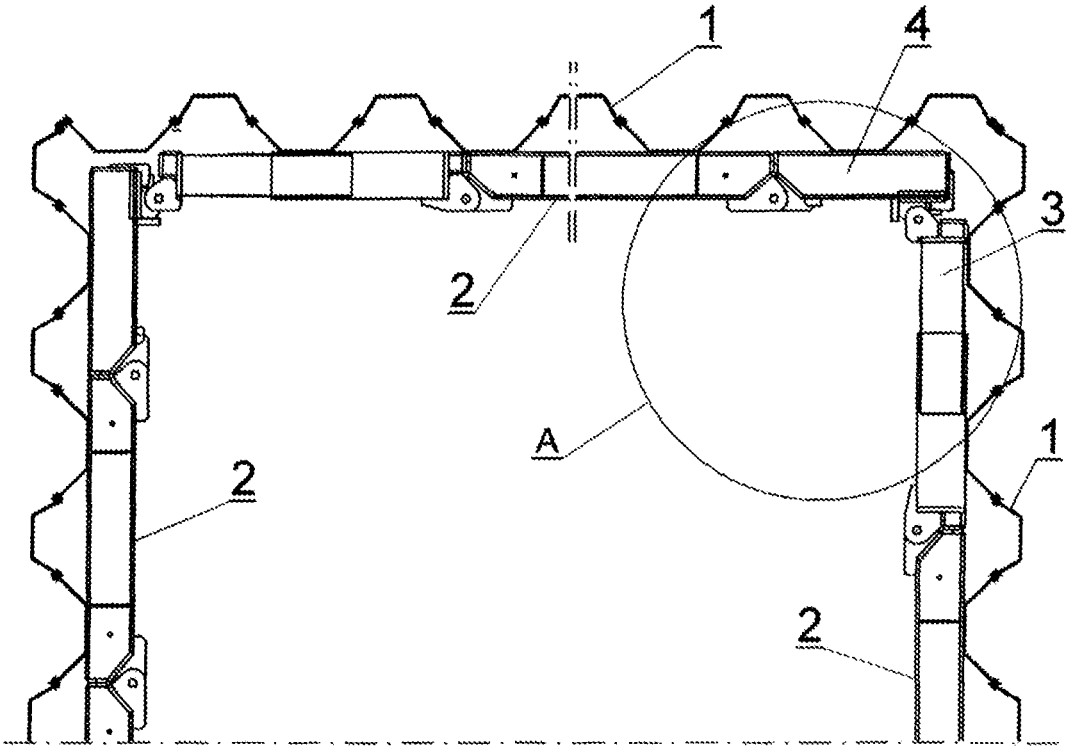
FIG. 1 shows a fragment of a rim of brace legs supporting the excavation sheet piles, FIG. 2 provides a magnified view of one of the corners of the rim of brace legs.
Figure 2:
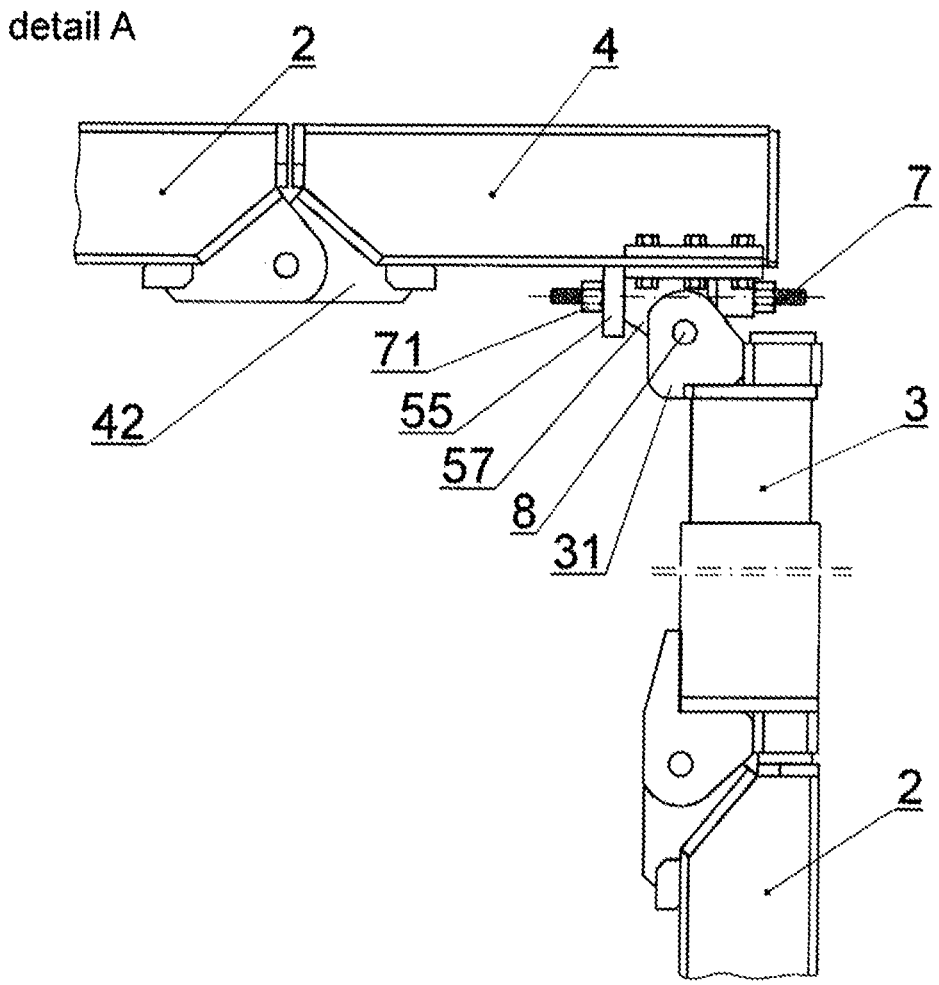
Figure 3:
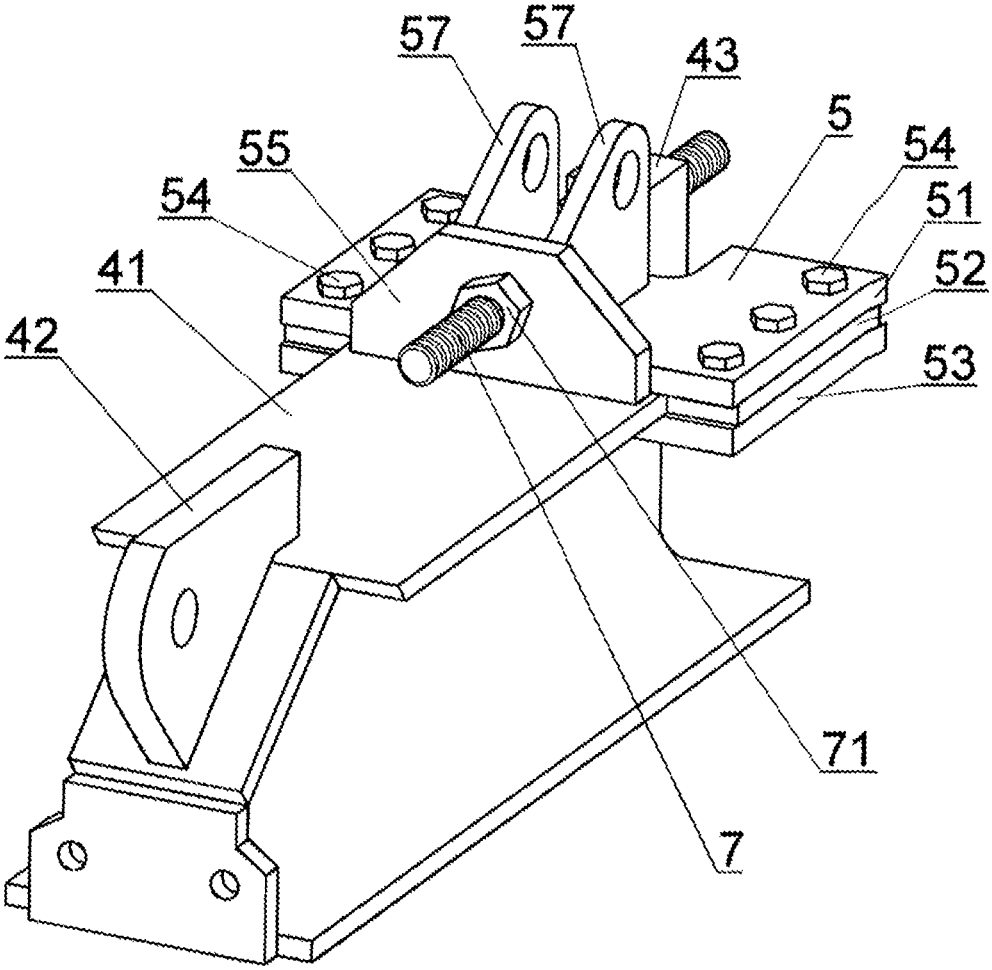
FIG. 3 is an axonometric projection of the tensioning unit, while FIG. 4 provides a partial longitudinal section of the tensioning unit.
Figure 4:
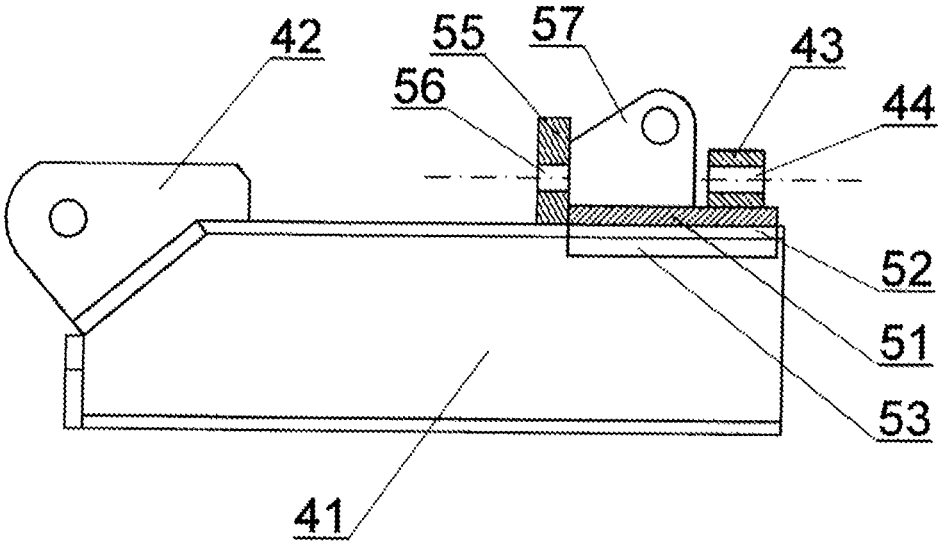

As demonstrated in the example of the invention execution variation, the quadrangular rim which supports excavation sheet piles 1 features two pairs of opposite brace legs 2. Telescopic spreader 3, terminated with mounting lug 31, is attached to one end of each brace leg 2, thus providing its extension. At the other end of the same brace leg 2, tensioning unit 4 is attached, also extending the former. Tensioning unit 4 comprises I-section 41 to which axially arranged lug 42 is mounted at one end, and retaining block 43, featuring centrally positioned straight-through block hole 44, is rigidly mounted on the opposite side. Between axially arranged lug 42 and retaining block 43, there is sliding panel 5 seated on I-section 41. Panel 5 is composed of base plate 51, protruding beyond the outline of I-section 41, and two limiting plates 53 attached to the base plate's sides by means of spacing plates 52. Limiting plates 53 are fixed to base plate 51 by means of two rows of mounting bolts 54, while after base plate 51, spacing plates 52 and limiting plates 53 have been tightly fixed together, and loosely embrace the flanges of I-section 41. Welded to base plate 51, there is transverse retaining element 55 with a centrally positioned straight-through tensioning hole 56 and two parallel lateral lugs 57. Block hole 44 and tensioning hole 56 are penetrated by tensioning stud 7 with working nuts 71 on both its ends. In each of the four corners of the rim of brace legs, attached to brace leg 2 of the first pair of brace legs, spreader 3 is coupled with tensioning unit 4 attached to brace leg 2 of the second pair of brace legs. The coupling between spreader 3 and tensioning unit 4 in the corner of the rim of brace legs is provided by pin 8 inserted into the overlapping holes of spreader mounting lug 31 and the pair of lateral lugs 57.

According to invention, the distance between the most protruding surfaces of opposite sheet piles 1 in the excavation corners is measured before brace legs 2 are set up inside the excavation, whereupon individual brace legs 2 are assembled, using an adequate number and unit lengths of the segments forming each brace leg, along with spreader 3 and tensioning unit 4, both mounted at the brace leg ends, so that their total lengths fall within the range established by the measurement results. At this point, the extent to which spreader 3 is to be spread is approximately pre-set in such a manner as to enable spread adjustment after brace leg 2 has been set in the excavation. Furthermore, in tensioning unit 4, nuts 71 on stud 7 are screwed off as much as possible so that panel 5 with lugs 57 can be moved away as far as possible from retaining block 43. Once all four brace legs 2 are set up in the excavation at an appropriate height matching sheet piles 1, in individual corners, mounting lugs 31 of spreader 3 and lateral lugs 57 of tensioning unit 4 are coupled using pins 8, whereupon the lengths of brace legs 2 are pre-adjusted to match the dimensions of excavation walls by extending the telescopic rods of spreaders 3. Then, using working nuts 71 to reduce the length of tensioning stud 7, the end of adjacent brace leg 2 is pressed against the sheet pile being supported. This procedure is repeated successively in all excavation corners, thus obtaining uniformly distributed pressure force applied by the entire rim of brace legs 2 on all sheet piles 1.

One advantage of the solution according to the invention is that it does not require the use of expensive telescopic spreaders, featuring built-in hydraulic cylinders of high load capacity and long travel, to obtain a sufficient force of pressure applied on sheet piles by brace legs. Another advantage of this solution is that it ensures improved structural safety, since the earth pressure is transferred to elements whose load capacity results from tensioning a stud instead of compressing a hydraulic cylinder, as in conventional solutions where the potential loss of the cylinder integrity may lead to structural failure or even collapse. It should be emphasized that, considering the solutions currently available in the market and commonly applied, every case of hydraulic cylinder integrity loss causes contamination of soil and groundwater. With regard to the foregoing, the solution according to the invention also reduces the risk of natural environment pollution as well as the costs of removing potential contaminants.

The invention claimed is:

1. A method for strutting brace legs in an earth-retaining structure of an excavation support system using a setup, comprising:

a rim of brace legs and spreaders, wherein a spreader, is attached to one end of each brace leg, thus forming a brace leg extension, while an extendable tensioning unit with a spread locking feature is attached to an other end of each said brace leg, further forming the brace leg extension, wherein, after the distance between opposite excavation sheet piles has been measured, and a length of the brace legs thus prepared has been pre-set according to the measurement results obtained, the brace legs are set inside the excavation at a pre-assumed depth in such a manner that, in the excavation corners, the ends of the brace legs terminated with spreaders become coupled with the ends of the subsequent brace legs terminated with tensioning units, and then, once all the brace legs have been coupled with each other, using pins, the brace legs are pressed against the sheet piles in the excavation corners, and a position of the ends of the brace leg, with the spreaders attached to the brace leg, and fixed by the tensioning units attached to subsequent brace legs.

2. A system of elements for strutting of brace legs in an earth-retaining structure of an excavation support system, comprising:

spreaders and two pairs of opposite brace legs, forming a quadrangular rim and supporting excavation sheet piles, distinctive in that a spreader, telescopic and terminated with a spreader mounting lug, is attached to one end of each brace leg, forming a brace leg extension, while an extendable tensioning unit is attached to an other end of the brace leg, providing the brace leg extension, where the tensioning unit comprises an I-section with an axially arranged lug mounted at its one end and a retaining block, featuring a centrally positioned straight-through block hole, rigidly mounted at the other end of the I-section, while between the axially arranged lug and the retaining block, seated on the I-section, there is a sliding panel composed of a base plate, protruding beyond the I-section outline, and two limiting plates attached to the base plate's sides by spacing plates, where the limiting plates are attached to the base plate, while upon being tightly fixed together, the base plate, the spacing plates and the limiting plates loosely embrace the I-section flanges; and wherein, welded to the base plate, is a transverse retaining element with a centrally positioned straight-through tensioning hole and two parallel lateral lugs, with the block hole and the tensioning hole being penetrated by a tensioning stud with working nuts on both its ends, while in each of the four corners of the rim of brace legs, attached to the brace leg of a first pair of brace legs of the two pairs of opposite brace legs, the spreader is coupled with the tensioning unit attached to the brace leg of a second pair of brace legs of the two pairs opposite brace legs with a pin inserted into a overlapping holes of the spreader mounting lug and of the pair of lateral lugs.

* * * * *